US009060601B2

(12) United States Patent
Landry et al.

(10) Patent No.: US 9,060,601 B2
(45) Date of Patent: Jun. 23, 2015

(54) FOLDABLE SHELVING UNIT AND METHOD FOR DEPLOYING AND COMPACTING SAME

(71) Applicant: PRATIKO INC., Richmond (CA)

(72) Inventors: Jean-Marc Landry, Richmond (CA); Michel Landry, Richmond (CA)

(73) Assignee: Pratiko Inc., Richmond (CA)

( * ) Notice: Subject to any disclaimer, the term of this patent is extended or adjusted under 35 U.S.C. 154(b) by 0 days.

(21) Appl. No.: 13/950,715

(22) Filed: Jul. 25, 2013

(65) Prior Publication Data

US 2014/0027396 A1 Jan. 30, 2014

(30) Foreign Application Priority Data

Jul. 27, 2012 (CA) ..... 2784048

(51) Int. Cl.
*A47B 43/00* (2006.01)
*A47B 57/16* (2006.01)

(52) U.S. Cl.
CPC ..... *A47B 43/00* (2013.01); *Y10T 29/49716* (2015.01); *A47B 57/16* (2013.01)

(58) Field of Classification Search
CPC ..... A47B 3/083; A47B 43/00; A47B 45/00; A47B 57/16; A47F 5/10; Y10T 29/49716
USPC ..... 211/72, 130.1, 132.1, 149, 182, 186, 211/189, 195, 198, 200, 201, 202; 108/99–101, 115, 166, 167, 171; 280/42, 651; 312/205, 257.1, 258, 261
See application file for complete search history.

(56) References Cited

U.S. PATENT DOCUMENTS

| | | | | |
|---|---|---|---|---|
| 1,625,294 | A * | 4/1927 | Whitesides | 108/175 |
| 2,483,263 | A * | 9/1949 | Cummings | 211/130.1 |
| 5,137,160 | A | 8/1992 | Santucci | |
| 5,746,331 | A * | 5/1998 | Kurtis | 211/149 |
| 7,389,887 | B2 | 6/2008 | Liang | |

(Continued)

FOREIGN PATENT DOCUMENTS

| | | | |
|---|---|---|---|
| CA | 2551353 A1 | 2/2007 | |
| CN | 201894353 U | 7/2011 | |
| GB | 383422 * | 11/1931 | A47B 3/002 |

OTHER PUBLICATIONS

Foldable double-layer book shelf, http://worldwide.espacenet.com/publicationDetails/biblio?DB=EPODOC&II=0&ND=3&adjacent=true&locale=en_EP&FT=D&date=20110713&CC=CN&NR=201894353U&KC=U, Jul. 18, 2013, Date Posted: Unknown.

*Primary Examiner* — Joshua Rodden
(74) *Attorney, Agent, or Firm* — Hovey Williams LLP

(57) ABSTRACT

A foldable shelving unit, its components, and a method for deploying and compacting same are described herein. The shelving unit includes first and second supports which are typically panels, and which help to support against the loads generated by the objects being stored. The shelving unit also includes shelf(ves) which has(ve) one pivotally engaged end, and one free end. The shelving unit also includes connecting members (e.g. arms) which connect the shelf(ves) to the supports, and allow the shelf(ves) to pivot about the supports. The shelving unit operates between a deployed position, where the shelf(ves) extends between the supports so as to support objects, and a compacted position, where the shelf (ves) is(are) rotated so as to bring the supports close to one another, thereby compacting the shelving unit. A corresponding method for deploying and compacting such a shelving unit is also described.

23 Claims, 10 Drawing Sheets

(56) References Cited

U.S. PATENT DOCUMENTS

| | | | | |
|---|---|---|---|---|
| 7,461,752 | B2 | 12/2008 | Li | |
| RE41,763 | E * | 9/2010 | Ng | 211/149 |
| 8,196,529 | B2 * | 6/2012 | Witkowski | 108/115 |
| 8,453,854 | B2 * | 6/2013 | Baran et al. | 211/201 |
| 8,468,956 | B2 * | 6/2013 | Parizek et al. | 108/64 |
| 8,523,197 | B2 * | 9/2013 | Baatz et al. | 280/42 |
| 2007/0131633 | A1 | 6/2007 | Ferm | |
| 2013/0062297 | A1 * | 3/2013 | Baran et al. | 211/126.14 |

* cited by examiner

FOLDABLE SHELVING UNIT AND METHOD FOR DEPLOYING AND COMPACTING SAME

RELATED APPLICATION

This application claims the benefit of Canadian Patent Application No. 2,784,048 filed on Jul. 27, 2012 and entitled "UNITÉ PLIABLE, SYSTÈME PLIABLE, PROCÉDÉS DE FABRICATION ET UTILISATIONS CORRESPONDANTES". This Canadian patent application is incorporated herein by reference in its entirety.

TECHNICAL FIELD OF THE INVENTION

The technical field relates to shelving, and more particularly, to a foldable shelving unit. It also relates to a method for deploying and compacting a foldable shelving unit.

BACKGROUND

Various types of shelving are used to store physical objects and items, in all manner of applications. It is also known to provide mobile shelving, or shelving which can be easily transported from place to place. One type of mobile shelving includes collapsible shelving, which is shelving which collapses onto itself. Collapsible shelving can be easily stored because it occupies a lower volume when collapsed. Collapsible shelving is also easier to transport when collapsed.

The nature and types of collapsible shelving can vary depending on its intended application. For example, collapsible shelving intended to be used in a locker may not be the same as collapsible shelving which is used to store large objects.

U.S. Pat. No. 7,461,752 B2 (formerly US 2007/0251907 A1) relates to a foldable article support rack which has a shelf-board and a plurality of bearing legs joined to the shelf-board at spaced locations to support the shelf-board. The shelf-board includes two daughter boards that are connected in a manner to be foldable along a line. The foldable article support rack further includes telescopic link mechanisms connected to the daughter boards and the bearing legs. The telescopic link mechanisms are operable to selectively fold the daughter boards and the bearing legs into a plane for storage or stretch the daughter boards and the bearing legs for use.

U.S. Pat. No. 7,389,887 B2 (formerly US 2006/0226101 A1) relates to a portable shelf including a pair of shelf plates each having two folding members pivotally connected with each other by inner edges. The portable shelf also includes a pair of side frames pivotally connecting the two plates to form a rectangular body, and a folding arrangement including two connecting guiders extended from the inner edges of the upper folding member to the inner edges of the lower folding member. It also includes two reinforcement sliders which are pivotally coupled with the bottom frame and slidably mounted along the connecting guiders respectively.

Other documents in this field which are known the Applicant include: CA 2,551,353; CN 201894353 U; U.S. Pat. No. 5,137,160; and US 2007/0131633.

BRIEF SUMMARY OF THE INVENTION

It is therefore an aim of the present invention to address the above-mentioned issues.

According to a general aspect, there is provided a foldable shelving unit, comprising: first and second supports; at least one shelf having opposed end portions and a supporting surface, one of the end portions being pivotally mountable to the first support; and at least two connecting members, each one of the connecting members having a first end and an opposed second end, each one of the first ends being pivotally mountable to the at least one shelf between the end portions, and each one of the second ends being pivotally mountable to the second support. The foldable shelving unit is operable between a deployed position wherein the at least one shelf and the at least two connecting members are pivoted to configure the first and second supports in a distal configuration with the at least one shelf extending therebetween, and a compacted position wherein the at least one shelf and the at least two connecting members are pivoted to configure the first and second supports in a proximal configuration.

In an embodiment, the at least one shelf is at least two or more spaced-apart shelves, each shelf being spaced apart by at least a shelf length.

In an embodiment, the at least two connecting members are arms.

In an embodiment, the first and second supports are vertically oriented and substantially parallel to one another in the deployed position and the compacted position. The first and second supports may be panels.

In an embodiment, the at least one shelf has opposed side portions, each first end being pivotally engageable to one of the side portions. Each first end may be pivotally engageable to one of the side portions midway along a length of the side portions. Each of the at least two connecting members may extend inwardly of the side portions in the deployed position.

In an embodiment, the other end portion of the at least one shelf is a free end portion.

In an embodiment, each second end and the one of the end portions of the at least one shelf comprise a limiting heel, the limiting heels abutting against at least one of the first and second supports in the deployed position.

According to another general aspect, there is provided a vertical foldable shelving unit comprising: at least two supports; at least two spaced-apart shelves, each one of the shelves having a first end portion pivotally mountable to a first one of the supports and a free second end portion; and at least two connecting members, each one of the connecting members having a first end pivotally mountable to a respective one of the at least two shelves and a second end pivotally mountable to a second one of the supports, the at least two shelves and the at least two connecting members being pivotable between a compacted position wherein the at least two upright supports are in a proximal configuration and a deployed position, wherein the at least two shelves extend substantially horizontally between the at least two upright supports.

According to still another general aspect, there is provided a method for deploying and compacting a foldable shelving unit comprising first and second supports, at least one shelf pivotally mounted to the first support, and at least two connecting members pivotally mounted to the at least one shelf and the second support, the method comprising: pivoting the at least one shelf and the at least two connecting members in a first direction until the first and second supports are in a distal configuration with the at least one shelf extending therebetween, thereby deploying the foldable shelving unit; and pivoting the at least one shelf and the at least two connecting members in a second direction opposite the first direction until the first and second supports are in a proximal configuration, thereby compacting the foldable shelving unit.

In an embodiment, the first direction is downward and the second direction is upward.

In an embodiment, pivoting in the second direction comprises pivoting the at least one shelf and the at least two connecting members until the at least one shelf is inclined relative to the first and second supports at an angle not exceeding about 10°.

In an embodiment, the method further comprises stopping the pivoting in the first direction upon the at least one shelf or the at least two connecting members abutting against the first or second supports.

According to still another general aspect, there is provided a foldable shelving unit, comprising: a first support and a second support; and at least one shelf assembly comprising a shelf with a supporting surface and at least two connecting members, the shelf being pivotally engageable to one of the first support and the second support and the at least two connecting members being pivotally engageable to the other one of the first support and the second support at a first pivoting point thereof and pivotally engageable to the shelf at a second pivoting point thereof, spaced-apart from the first pivoting point. The foldable shelving unit is operable between a deployed position wherein the at least one shelf assembly is pivoted to configure the first and second supports in a distal configuration with the shelf extending therebetween, and a compacted position wherein the at least one shelf assembly is pivoted to configure the first and second supports in a proximal configuration.

In an embodiment, the at least one shelf assembly comprises at least two spaced-apart shelf assemblies with the shelf of a first one of the at least two shelf assemblies being pivotally engageable to the first support and the shelf of a second one of the at least two shelf assemblies being pivotally engageable to the second support.

In an embodiment, the shelf comprises opposed end portions, a first one of the end portions being pivotally engaged to the one of the first support and the second support and a second one of the end portions being a free end being adjacent to the other one of the first support and the second support in the deployed position.

In an embodiment, the first support and the second support extend substantially parallel to one another in the deployed position and the compacted position and the shelf of the at least one shelf assembly extends substantially perpendicular to the first support and the second support in the deployed position and defines an oblique angle with the first support and the second support in the compacted position.

In an embodiment, the supporting surface of the shelf is rigid and uncompactable.

BRIEF DESCRIPTION OF THE DRAWINGS

It will be noted that throughout the appended drawings, like features are identified by like reference numerals.

DETAILED DESCRIPTION

Figure 1:
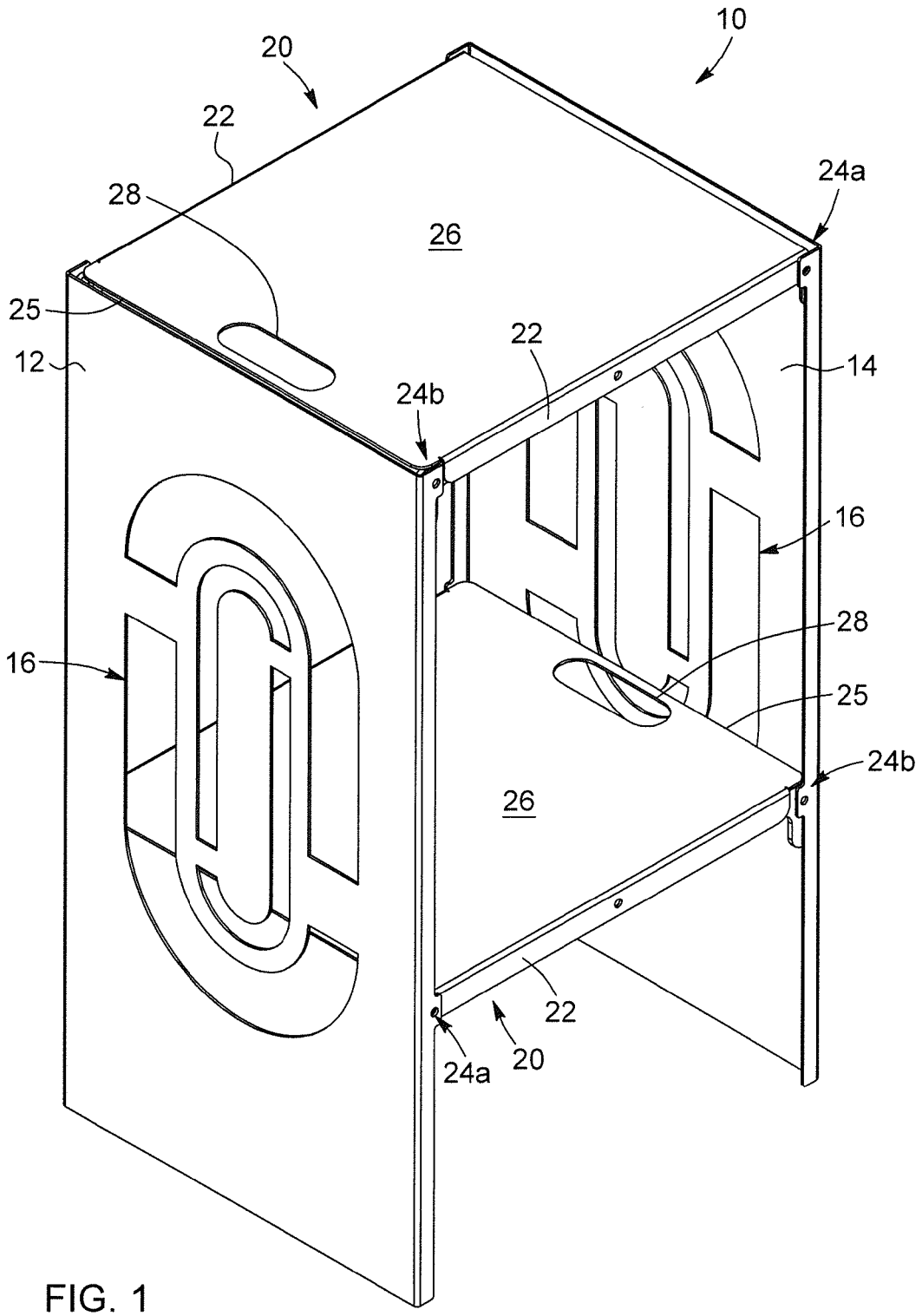
FIG. 1 is a perspective view of a foldable shelving unit in accordance with an embodiment.

Referring now to the drawings and, more particularly, referring now to FIG. 1, there is shown a foldable shelving unit 10. The foldable shelving unit 10 may be used for any of the purposes for which conventional shelving is employed. The term "foldable" refers to the ability of the shelving unit 10, as further explained below, to bend or to be brought together so that it can be reduced in size, and so that it can be set up. By reducing the shelving unit 10 in size, it can advantageously be more easily stored or transported as required. Similarly, the setup of the shelving unit 10 advantageously allows it to support objects, and to serve the purpose for which it was intended.

Figures 9, 9A:
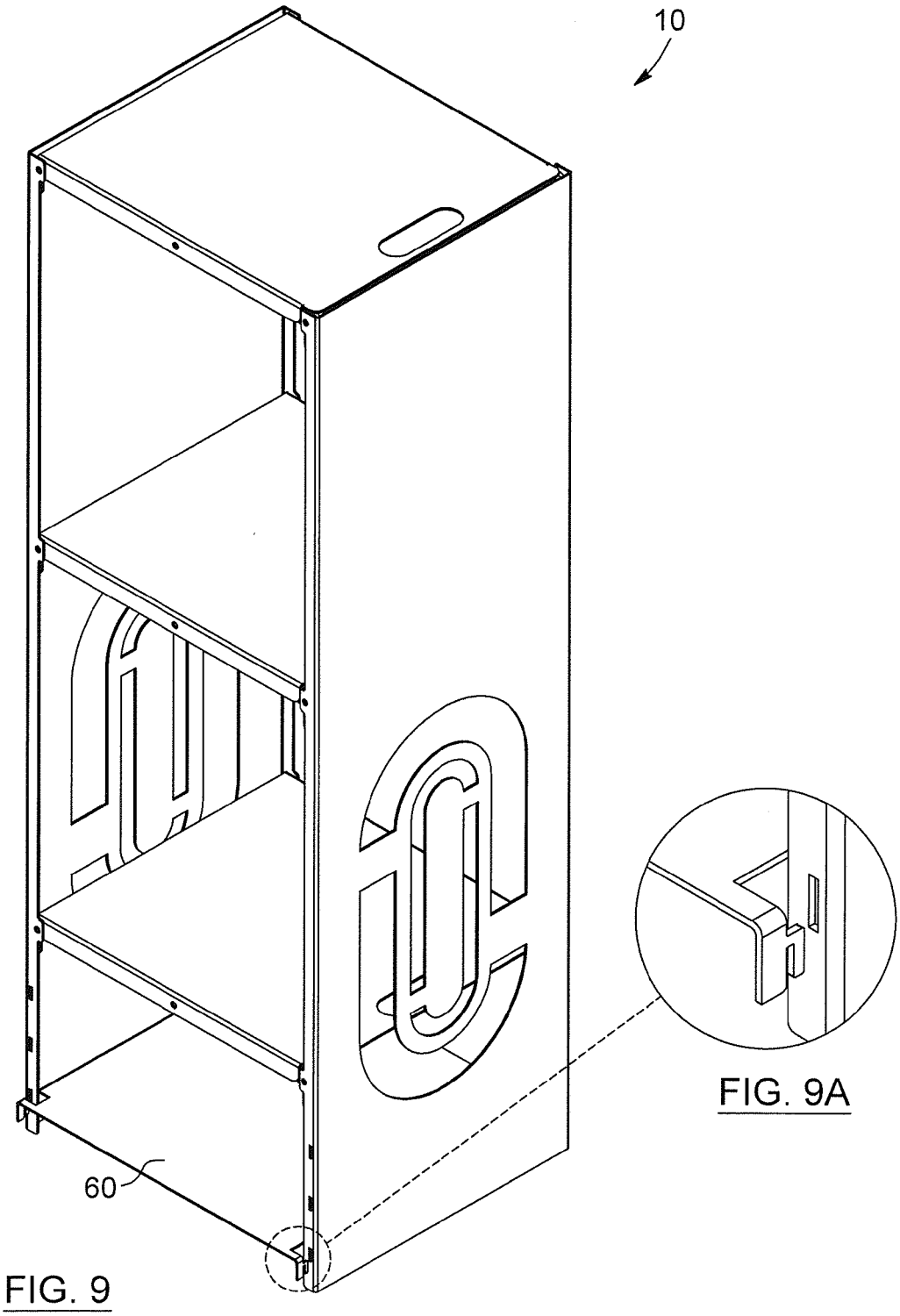
FIG. 9 is a perspective view of a foldable shelving unit having three shelves and a tray in accordance with an embodiment.
FIG. 9A is an enlarged view showing the mounting of the tray of to the foldable shelving.
Figures 10, 10A, 10B:
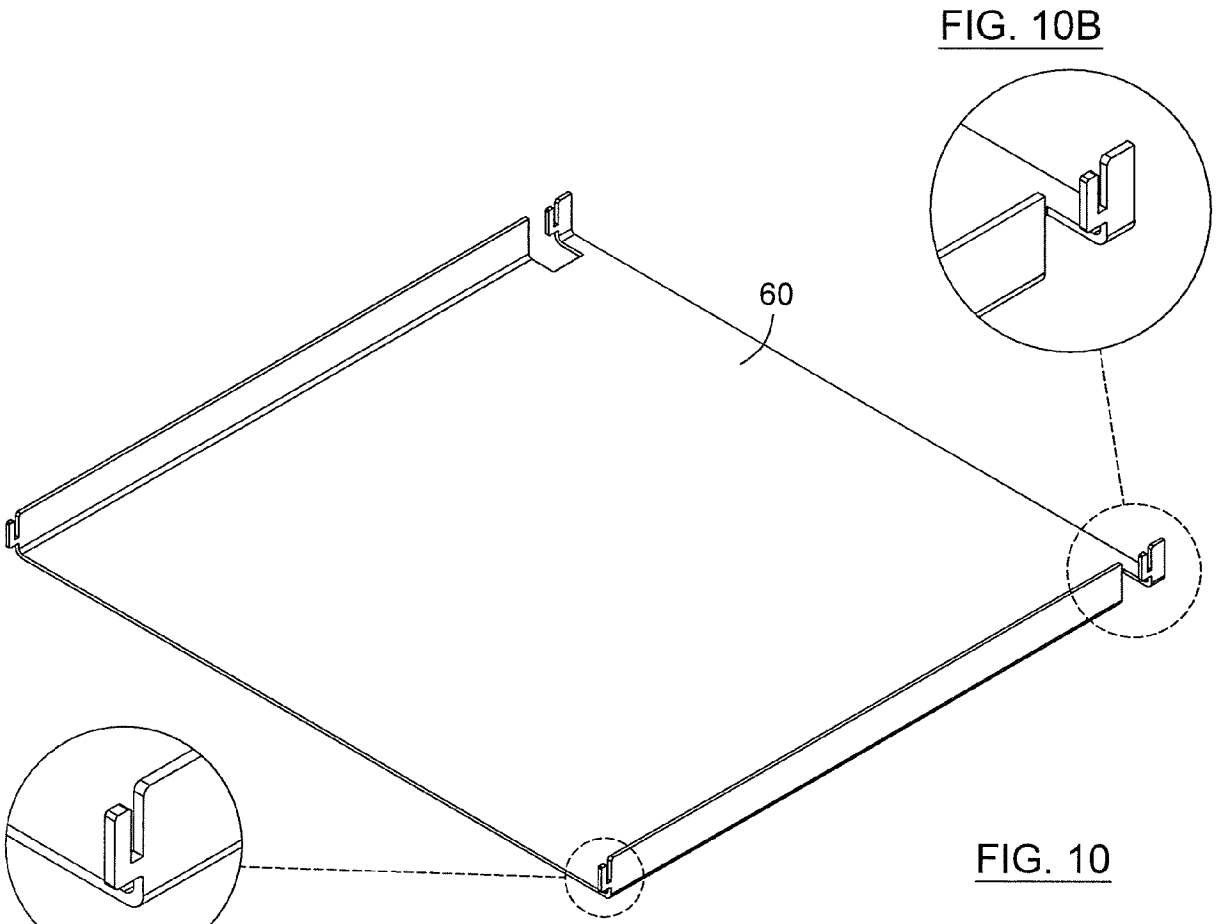
FIG. 10 is a perspective view of the tray shown in FIG. 9.
FIGS. 10A and 10B are enlarged views of different connective mounts of the tray shown in FIG. 9.

The shelving unit 10 is not limited to the particular configuration shown in the Figures. Indeed, and although it is shown in a vertical orientation, the shelving unit 10 can also be horizontal or inclined at other suitable angles. Similarly, the shelving unit 10 can have more than two supports so that it resembles a multi-leveled box or enclosure. Further optionally, the shelving unit 10 can include an insert, such as a removable tray 60, an example of which is shown in FIGS. 9 to 10B. The tray 60 can be removably attached to any part of the shelving unit, such as the first and second supports. Optionally, and as shown in FIGS. 10 to 10B, the tray 60 can have connective mounts near its ends which fit into corresponding grooves on the shelving unit 10. This advantageously allows the tray 60 to be securely attached to the shelving unit 10, and increases the stability of the tray 60 and the objects to be stored thereon.

It is thus apparent that other possible configurations, shapes, and orientations are possible for the shelving unit 10, and expressions such as "placed on the shelf", "lower", "upper", "upright", "downward", "upward", or other similar expressions should not be taken as limiting the shelving unit 10 to a particular configuration or orientation. Furthermore, although shown in the Figures as an assembled device, the shelving unit 10 and its components can be provided or sold separately and later assembled by a user using conventional tools and mechanical fasteners.

Figure 2:
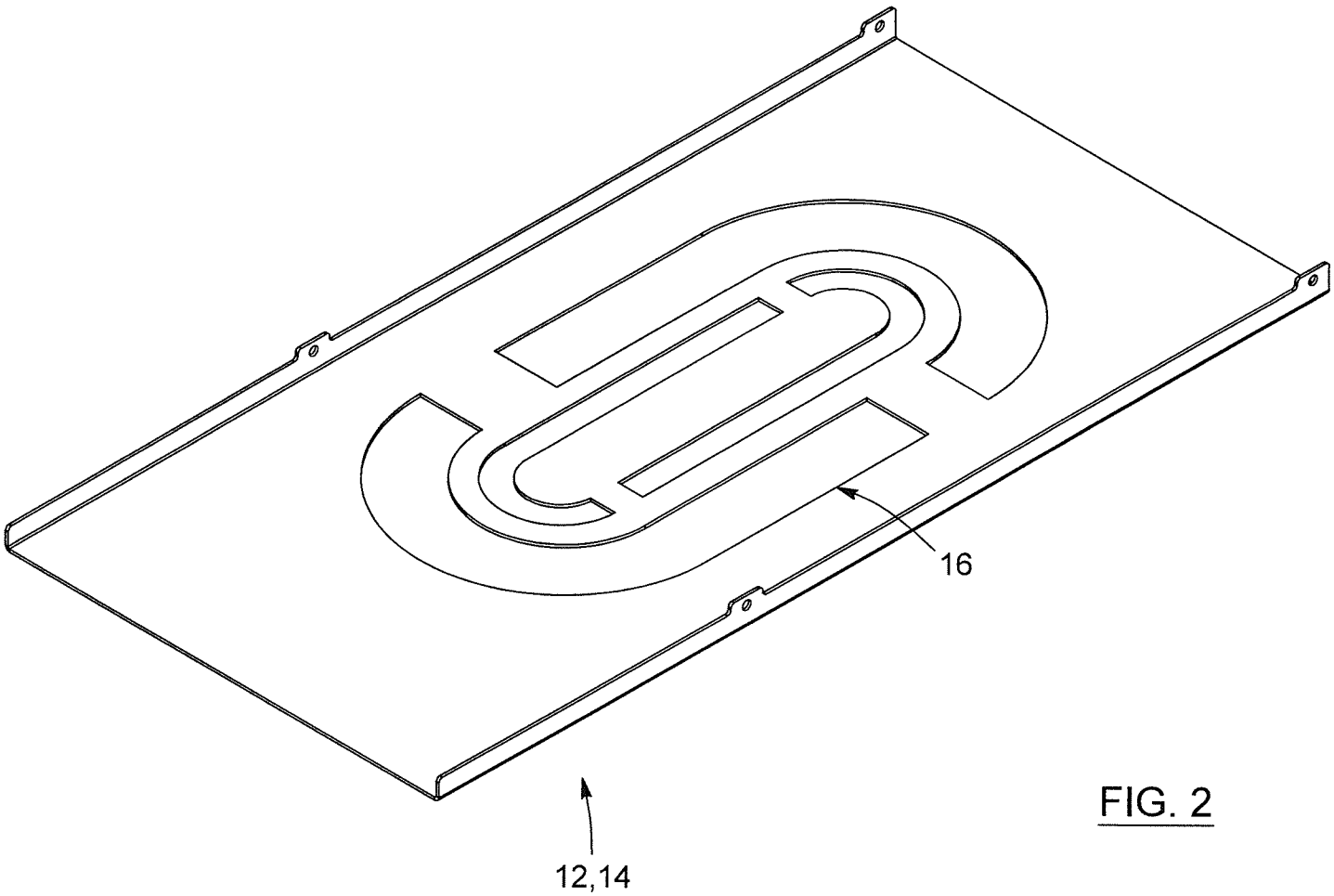
FIG. 2 is a perspective view of a support of a foldable shelving unit in accordance with an embodiment.

The shelving unit 10 includes a first support 12 and a second support 14, examples of which are shown in FIGS. 1 and 2. Either one of the terms "first" and "second" can be used to designate any of the supports 12,14. Stated more clearly, the first support 12 shown in the Figures can also be referred to as the second support 14, and vice versa. The first and second supports 12,14 provide structure to the shelving unit 10 and allow it to better resist the loads generated during the deployment and compaction of the shelving unit 10, and when objects are placed in the shelving unit 10. As such, the supports 12,14 are made from substantially solid materials, and are substantially integral. In most embodiments, but not necessarily all, the supports 12,14 are panels, such as upright panels, or walls, as exemplified in the Figures. In some embodiments, the first support 12, the second support 14, or both, may have a cut-out section 16. The cut-out second 16 may advantageously reduce the weight of the supports 12,14, thus reducing material costs. The cut-out section 16 may also allow for branding or marking of the shelving unit 10, thereby advantageously allowing vendors of the shelving unit 10 to promote their name or logo.

The supports 12,14 can have the same shape and configuration as one another, as shown in FIGS. 1 and 2, or they can differ. Similarly, and as previously explained, the supports 12,14 can be oriented upright, vertically, horizontally, or at some angle in between. The orientation of the supports 12,14 may affect the function of the shelving unit 10. In the embodiment where the first and second supports 12,14 are oriented horizontally, the shelving unit 10 can serve as a book shelf or as a box, for example. As shown in FIGS. 1 and 2, the supports 12,14 can be parallel to one another vertically or horizontally, and separated by some distance so as to define a volume in which objects can be placed.

Figure 3:
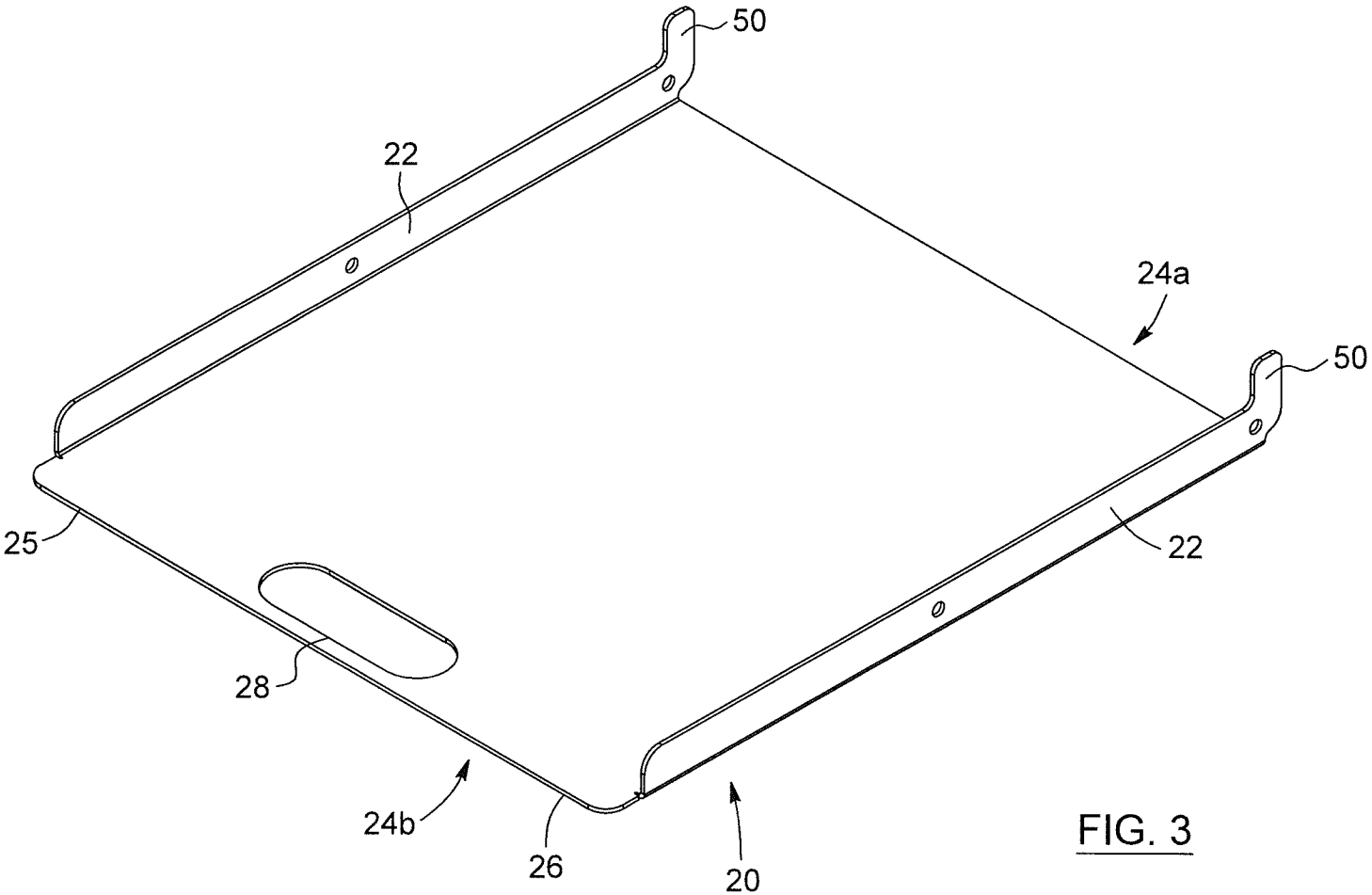
FIG. 3 is a perspective view of a shelf of a foldable shelving unit in accordance with an embodiment.

The shelving unit 10 also includes at least one shelf 20, an example of which is shown in FIGS. 1 and 3. The at least one shelf 20 serves to support the weight of whatever object is placed upon it when the shelving unit 10 is in the unfolded configuration. The at least one shelf 20 can be more than one shelf 20, such as two shelves 20 as shown in FIGS. 1 and 3, or three shelves 20 as shown in FIGS. 6 to 9. When multiple shelves 20 are included, each shelf 20 level can be separated from an adjacent shelf 20 level by at least the length of the shelf 20. This can advantageously allow the shelves 20 to pivot without hindrance, and permits each shelf 20 to have substantially the same arc of rotation.

Each shelf 20 may have opposed side portions 22, opposed end portions 24, and a supporting surface 26 which extends between the side portions 22 and end portions 24. The term "opposed" refers to the location of the side portions 22 and end portions 24, in that each side portion 22 and each end portion 24 are located on either sides of the shelf 20. In most embodiments, but not necessarily all, the shelf 20 is rectangular and thus has two side portions 22 and two end portions 24. The supporting surface 26 is typically a planar surface which covers the area between the opposed side portions 22 and the end portions 24. It can be rigid and relatively difficult to compact, in that the supporting surface 26 may not be able to fold onto itself and may not contain hinges or other similar devices. It thus assists the shelf 20 in supporting the weight of the objects placed upon it when the shelving unit 10 is deployed. In some embodiments, the supporting surface 26 can have a handle 28, such as an apertured handle, near the one of the end portions 24*a*,24*b*. The handle 28 can be any graspable article or aperture which would allow a user to grab the shelf 20 and apply a force, such as to deploy or compact the shelving unit 10, for example. In some embodiments, the supporting surface 26 can be decorated or perforated, or otherwise given a distinguishing characteristic.

One of the end portions 24 of each shelf 20 is pivotally mounted to one of the first support 12 and the second support 14. Such a mounting allows the shelves 20 to pivot or rotate relative to the supports 12,14, thereby helping in the deployment and compaction of the shelving unit 10. In the example shown in FIG. 1, the end portion 24*a* of a lower shelf 20 is shown as being pivotally mounted to the first support 12, while the end portion 24*a* of an upper shelf 20 is shown as being pivotally mounted to the second support 14. In some embodiments, only a part of the end portions 24*a* are pivotally mounted to the supports 14. This part can be the sides of the end portions 24*a*. The expressions "pivotally mounted", "pivotally mountable", or "pivotally engageable" refer to the attachment of the shelf(ves) 20 to the supports 12,14 so as to allow the corresponding shelf 20 to rotate with respect to the supports 12,14. The other end portion 24*b* (i.e. the end portion 24*b* not pivotally mounted to the supports 12,14) is a free end portion. The term "free" as used to describe the end portion 24*b* refers to its detachment from the other one of the supports 12,14 to which the end portion 24*a* is pivotally mounted. This allows the other end portion 24*b* to move unhindered with respect to the supports 12,14, which further advantageously aids in the deployment and compaction of the shelving unit 10. In most embodiments, but not necessarily all, the movement of the other end portion 24*b* follows an arc according to the pivot of the shelf 20 about the mounted end portion 24*a*. Optionally, the other end portion 24*b* may have a lip 25 which advantageously allows the other end portion 24*b*, and thus the shelf 20, to rest on a corresponding ledge of one of the supports 12,14, thereby helping to support the objects placed on the shelf 20.

Figure 4:
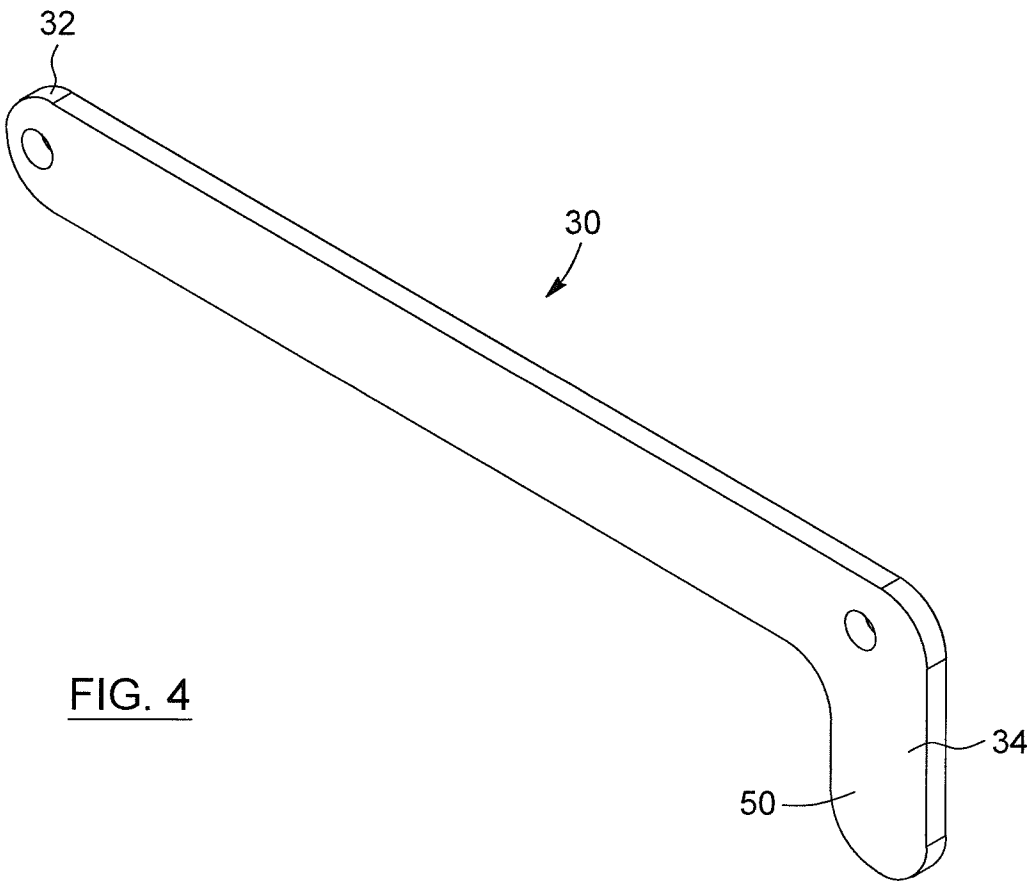
FIG. 4 is a perspective view of a connecting member of a foldable shelving unit in accordance with an embodiment.
Figure 5:
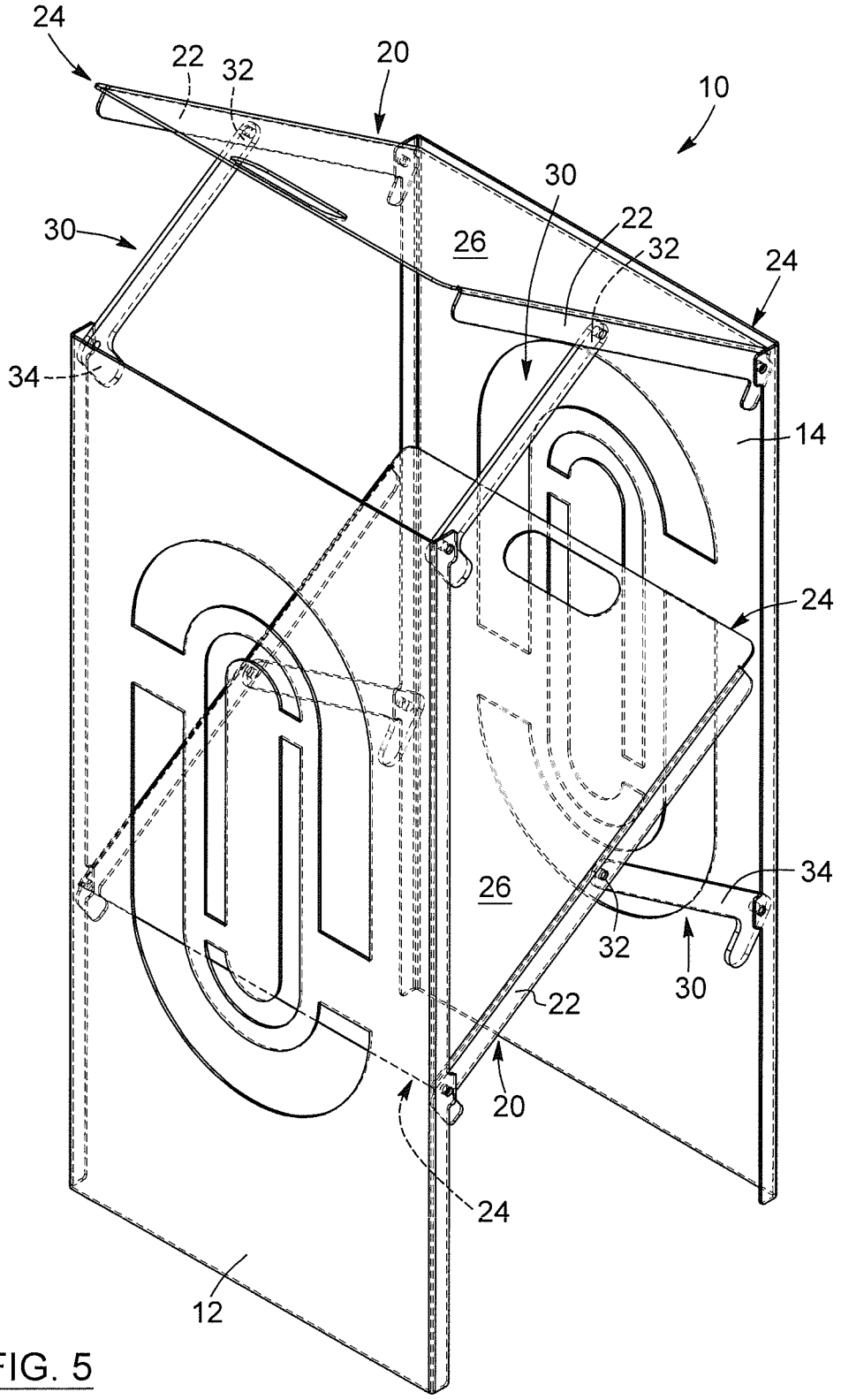
FIG. 5 is a perspective view of a foldable shelving unit shown transitioning from a deployed position to compacted position, or vice versa, in accordance with an embodiment.

The shelving unit 10 also includes at least two connecting members 30, examples of which are shown in FIGS. 4 and 5. Each connecting member 30 provides support to the shelving unit 10 against the loads generated when objects are placed thereon. Each connecting member 30 also assists in the deployment and compaction of the shelving unit 30, as more amply explained below. As such, the connecting members 30 and the shelves 20 can be considered a shelf assembly, which can be pivoted together so as to deploy and compact the shelving unit 10.

Each connecting member 30 can be any component which joins the shelves 20 to the other one of supports 12,14, i.e. the one to which the shelf 20 is not pivotally mounted. The connecting members 30 are therefore not limited to the configuration exemplified in the Figures. For example, the connecting members 30 can consist of a pivoting plate pivotally engageable with a shelf 20 and a support 12,14. In most embodiments, but not necessarily all, the connecting members 30 are arms, as shown in the Figures. In these embodiments, the expression "at least two" refers to the number of connecting members 30 (e.g. arms), which are typically but not always provided in pairs. More particularly, in most embodiments, two connecting members 30 are used for each shelf 20 of the shelving unit 10. Further optionally, each connecting member 30 can have a length which is roughly equal to half the length of the corresponding shelf 20 to which it is mounted.

Each connecting member 30 has a first end 32 and an opposed second end 34. The first and second ends 32,34 form the extremity regions of each connecting member 30, and serve to link each connecting member 30 to a corresponding shelf 20 and support 12,14, respectively. More particularly, each first end 32 is configured for being pivotally mounted to a corresponding shelf 20, at some location on the shelf 20 between its end portions 24. In some embodiments, each first end 32 is pivotally mountable to one of the side portions 22 of a shelf 20. This advantageously allows each connecting member 30 to remain near the edge of each shelf 20, thereby maximizing the available space for storage of objects. In some embodiments, each first end 32 is pivotally mountable to a corresponding side portion 22 of the shelf 20, at a position which is midway along the length of the side portion 22, as exemplified in FIG. 5. Further optionally, each connecting member 30 can be mounted slightly inwardly of the side portions 22. This advantageously can allow for the supporting surface 26 of each shelf 20 to rest upon each connecting member 30 when the shelving unit 10 is in the deployed position, thereby further providing support against the loads generated by the objects placed upon the supporting surface 26. Alternatively, each connecting member 30 can be mounted slightly outwardly of the side portions 22, which can provide the same advantage as the inwardly-mounted connecting members 30.

Each second end 34 is pivotally mountable to a support 12,14. In most embodiments, the second end 34 is mounted to a support 12,14 which is different from the support 12,14 to which is mounted the shelf 20. In light of the preceding, it can be appreciated that the connecting members or connecting members 30 advantageously serve to link the shelves 20 to the supports 12,14, thereby allowing the shelves 20 to pivot with respect to the supports 12,14 so as to be deployed and compacted.

Having describes some of the components and features of the shelving unit 10, its operation between a deployed position and a compacted position will now be described in reference to FIGS. 6 to 8.

The pivotable mounting of the connecting members 30 and shelves 20 described above defines multiple pivot axes and pivoting points. Referring to FIG. 7, a first pivot axis 40 and pivoting point is created when the end portion 24 of each shelf 20 is pivotally mounted to the first support 12. A second pivot axis 42 or pivoting point is created when each first end 32 is pivotally mounted to each of the side portions 22 of the shelves 20. A third pivot axis 44 or pivoting point is created when each second end 34 is pivotally mounted to the second support 14. Each one of the first, second, and third pivot axes 40,42,44 are substantially parallel to one another, which advantageously allows the shelves 20 and the connecting member 30 to rotate in the same angular direction. In some embodiments, at least the first pivot axis 40 and the third pivot axis 44 lie in the same horizontal plane at all times, and particularly when the shelving unit 10 is in the deployed position, as exemplified in FIG. 6. In some embodiments, each one of the pivoting points is spaced apart from the other pivoting points. Further optionally, the second pivot axis 42 can also lie in this horizontal plane when the shelving unit 10 is in the deployed position.

These pivot axes 40,42,44 allow the shelving unit 10 to operate between a deployed position and a compacted position, both of which will be described now in more detail.

Figure 6:
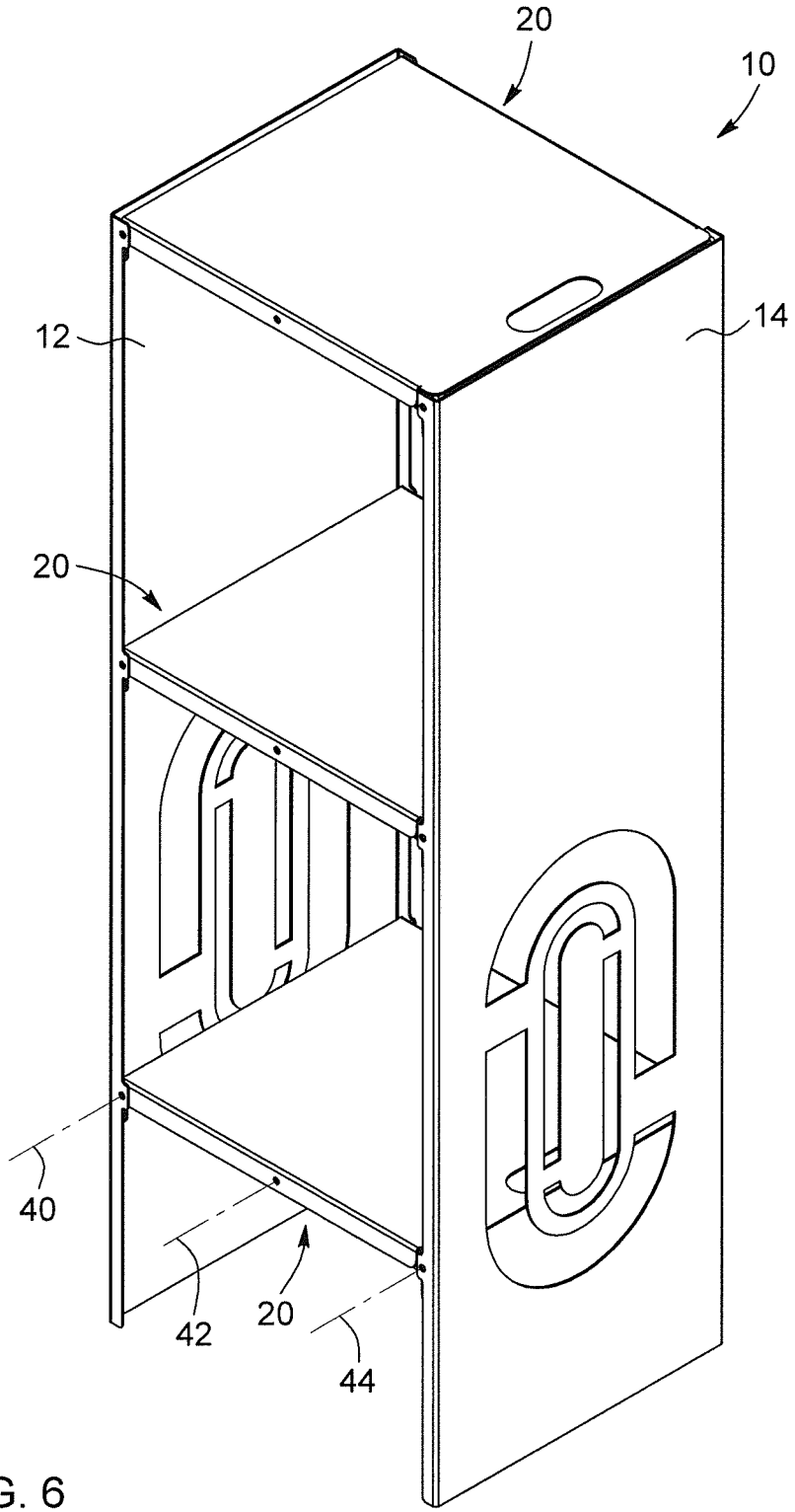
FIG. 6 is a perspective view of a foldable shelving unit having three shelves in accordance with an embodiment.

In the deployed position, an example of which is shown in FIG. 6, the shelves 20 and the connecting members 30 are pivoted so as to configure the first and second supports 12,14 in a distal configuration with the shelves 20 extending therebetween, thus deploying the shelving unit 10. The terms "deploy", "deployment", and "deploying" refer to the disposition of the shelving unit 10 in an operating position where it is ready to receive, support, and store objects. An example of the pivot of the shelves 20 and the connecting members 30 is shown in FIG. 7, where they are shown pivoting, for example in a downward direction, so as to be substantially perpendicular to the supports 12,14. The expression "so as to configure" refers to the ability of the pivoting shelves 20 and the connecting members 30 to displace the first and second supports 12,14 into a distal configuration. The expression "distal configuration" refers to the position of the supports 12,14 with respect to one another, in that both supports 12,14 are situated furthest from each other and the center of the shelving unit 10. In this distal configuration, the shelves 20 extend between the supports 12,14. In most embodiments, but not necessarily all, this extension positions the shelves 20 so as to be substantially perpendicular to the first and second supports 12,14 when deployed. For example, in the embodiment where the shelving unit 10 is vertically oriented, the extension of the shelves 20 places them in a substantially horizontal position.

Figure 7:
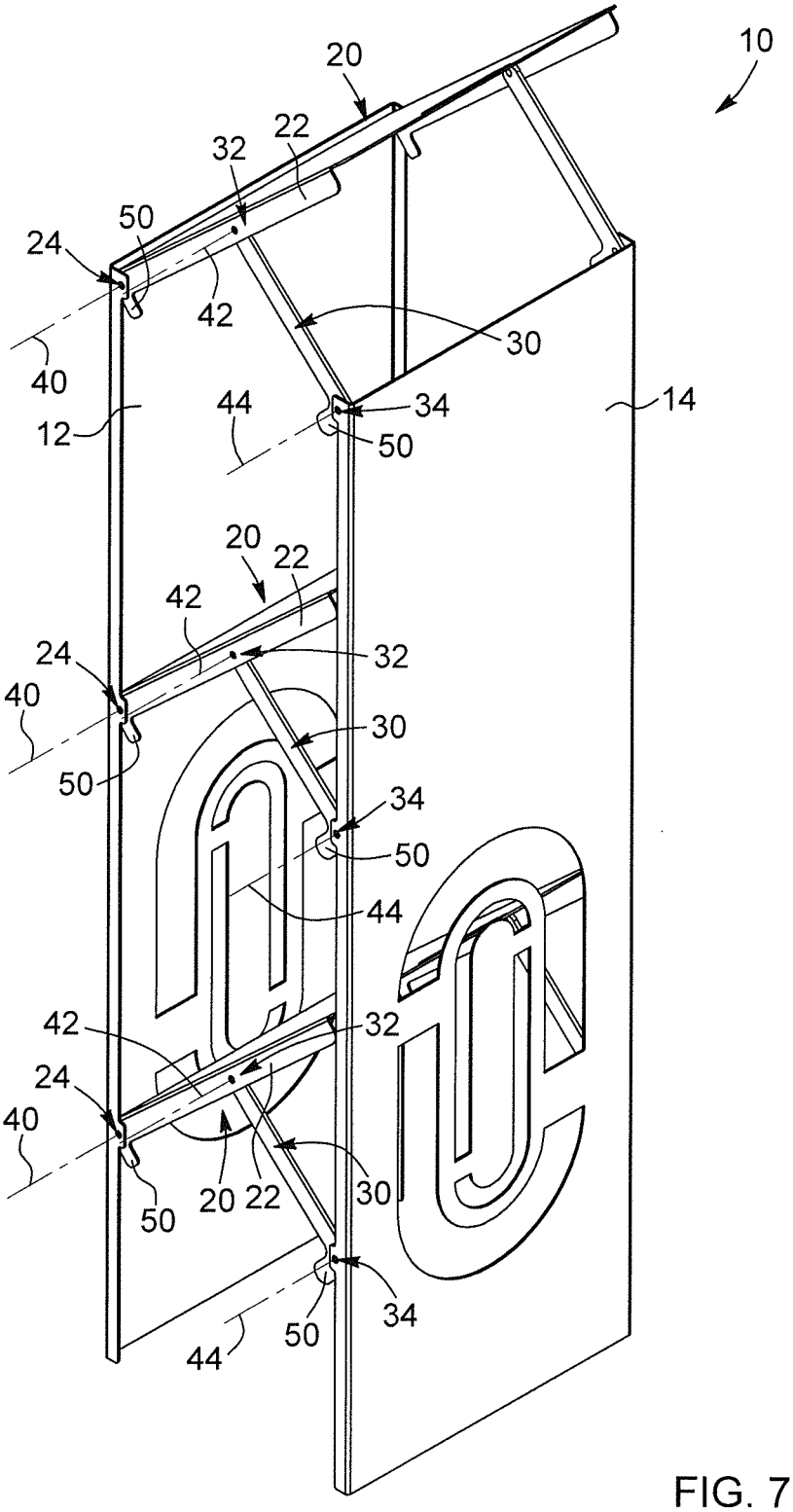
FIG. 7 is a perspective view of the foldable shelving unit of FIG. 6 shown transitioning from a deployed position to a compacted position, or vice versa.

In some embodiments, the pivoting of the shelves 20 and connecting members 30 when in the distal configuration can be arrested by limiting heels 50, examples of which are shown in FIGS. 3, 4, and 7. The limiting heels 50 can be located on each of the second ends 34 of the connecting members 30, and on each of the mounted end portions 24 of the shelves 20. In some embodiments, but not necessarily all, the limiting heel 50 can consist of a projection extending perpendicularly from the end portion 24 of the shelf 20, or from the second end 34. The limiting heels 50 can arrest or stop the pivoting of the shelves 20 and the connecting members 30 in the distal configuration by abutting against the supports 12,14. In so doing, the limiting heels 50 advantageously secure the shelving unit 10 in the deployed position, and help it to better resist the loads generated by objects placed therein, thereby providing stability in both the longitudinal and lateral directions.

Figure 8:
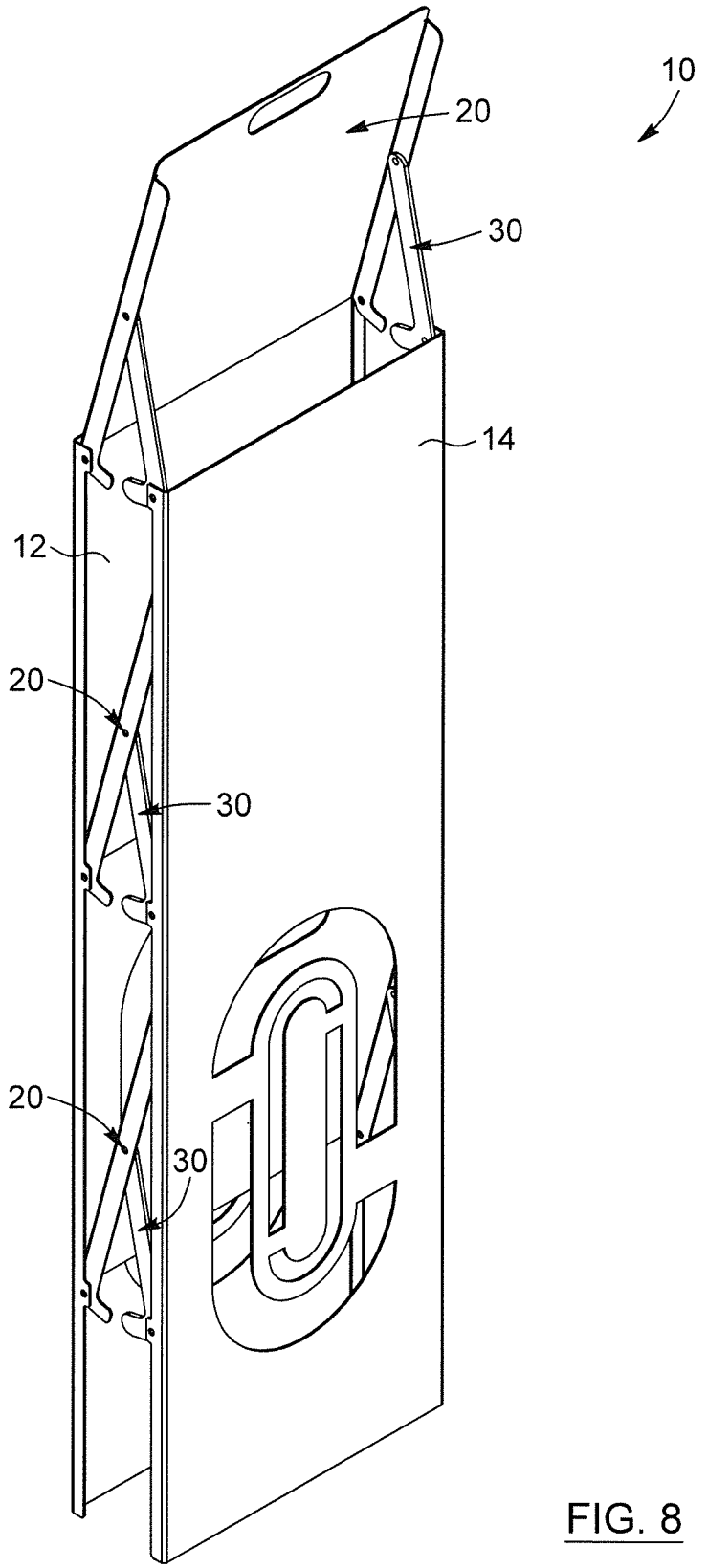
FIG. 8 is a perspective view of the foldable shelving unit of FIG. 6 shown in a compacted position.

Turning now to the compacted position, an example of which is shown in FIG. 8, the shelves 20 and the connecting members 30 are pivoted so as to configure the first and second supports 12,14 in a proximal configuration, thus compacting the shelving unit 10. The terms "compact", "compaction", and "compacting" refer to the disposition of the shelving unit 10 in a position where it is "collapsed" or inwardly folded so as to be moved to another location or for storage. An example of the pivot of the shelves 20 and the connecting members 30 is shown in FIG. 7, where they are shown pivoting, for example in an upward direction. This can place the shelves 20 in a position where they are inclined relative to the first and second supports 12,14. The term "inclined" refers to the deviation of shelves 20 (i.e. they are oblique) from the plane in which the supports 12,14 lie. In some embodiments, this deviation does not exceed about 10°, such that the shelves 20 are inclined relative to supports 12,14 at an angle not exceeding about 10°. Alternatively, the deviation can vary, and can also be zero such that shelves 20 are parallel to the supports 12,14. The expression "proximal configuration" refers to the position of the supports 12,14 with respect to one another, in that both supports 12,14 are situated closest to each other and near the center of the shelving unit 10.

In both of the deployed and compacted position, each one of the shelves 20 and each one of the connecting members 30 can be pivotally engaged with alternate supports 12,14. For example, in FIG. 5, the upper shelf 20 and upper connecting members 30 are shown as being pivotally engaged with the second support 14 and the first support 12, respectively. The lower shelf 20 and lower connecting members 30 are shown as being pivotally engaged with the first support 14 and the second support 12, respectively. This optional configuration allows the shelves 20 to pivot in opposite directions and still allow for the shelving unit 10 to be in the deployed or compacted position.

In accordance with another general aspect, there is provided a method for deploying and compacting a foldable shelving unit 10, such as the one described above. The shelving unit 10 includes first and second supports 12,14, at least one shelf 20 pivotally mounted to the first support 12, and at least two connecting members 30 pivotally mounted to the at least one shelf 20 and the second support 14.

The method includes the step of pivoting the one or more shelves 20, as well as the two or more connecting members 30, in a first direction until they are in a distal configuration, as explained above. This distal configuration allows the shelves 20 to extend between the supports 12,14, thus providing a surface upon which objects can be placed (i.e. the deployed position). In some embodiments, the first direction is downward, such as when the shelving unit 10 is in a vertical orientation. As previously explained, this downward pivoting can be stopped when the shelf 20 or the connecting members 20 abut against the first or second supports 12,14.

The method includes the step of pivoting the one or more shelves 20, as well as the two or more connecting members 30, in a second direction until they are in a proximal configuration, as explained above. This second direction is opposite the first, and thus can be in an upward direction. This proximal configuration allows the shelves 20 to collapse onto themselves so as to reduce the volume occupied by the shelving unit 10 and thus facilitate transport or storage of the shelving unit (i.e. the compacted position). In some embodiments, the pivoting in the second direction occurs until the shelves 20 are inclined relative to the first and second supports 12,14 so as to form an angle not exceeding about 10°. When the foldable shelving unit 10 is compacted or deployed, the first and second supports 12,14 remain substantially parallel to one another. They are thus translated away from one another from the proximal configuration in the compacted position to the distal configuration in the deployed position.

In light of the preceding, it can thus be appreciated that the shelving unit 10 described herein, as well as the method for deploying and compacting same, may provide at least some of the following advantages: a heightened three-dimensional stability even under significant loads generated by the objects stored on the shelving unit 10; relatively easy to manufacture and assemble; a level of compactness which can significantly facilitate storage and transport; and a greater resistance to heavy loads.

Such advantages may allow the shelving unit 10 to be used for stand-alone shelving, such as when used to support documents or other objects. For example, such a shelving unit 10 can be used next to a fax machine or printer, or to stack or support the weight of magazines or catalogues in a reception area or garage. Such advantages may also allow the shelving unit 10 to be inserted into an existing structure. For example, the shelving unit 10 can be inserted into or attached to an armoire or large wardrobe. In another example, the shelving unit 10 can be used within a locker, such as one used by school students or factory workers. Such a shelving unit 10 can allow for a more efficient division and use of the space within the locker. The shelving unit 10 can also be used as a structural support against very specific loads.

Furthermore, the supports 12,14, shelves 20, and connecting members 30 can all be respectively identical pieces, thereby advantageously facilitating the manufacturing of these components and the lower the costs of manufacturing and maintaining inventory.

Although the embodiments of the shelving unit 10 and corresponding parts thereof consist of certain geometrical configurations as explained and illustrated herein, not all of these components and geometries are essential to the invention and thus should not be taken in their restrictive sense. It is to be understood, as also apparent to a person skilled in the art, that other suitable components and cooperation therein between, as well as other suitable geometrical configurations, may be used for the shelving unit 10 according to the present invention, as it will be briefly explained herein and as can be easily inferred here from by a person skilled in the art. Moreover, it will be appreciated that positional descriptions such as "above", "below", "left", "right" and the like should, unless otherwise indicated, be taken in the context of the figures and should not be considered limiting.

Several alternative embodiments and examples have been described and illustrated herein. The embodiments of the invention described above are intended to be exemplary only. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. It is understood that the invention may be embodied in other specific forms without departing from the spirit or central characteristics thereof. The present examples and embodiments, therefore, are to be considered in all respects as illustrative and not restrictive, and the invention is not to be limited to the details given herein. Accordingly, while the specific embodiments have been illustrated and described, numerous modifications come to mind without significantly departing from the spirit of the invention. The scope of the invention is therefore intended to be limited solely by the scope of the appended claims.

The invention claimed is:

1. A foldable shelving unit, comprising:

first and second supports with lower ends and opposed upper ends;

at least one shelf having opposed end portions, spaced-apart and extending substantially parallel to one another, opposed side portions extending between the end portions, and a supporting surface extending between the end portions and the side portions, one of the end portions being pivotally mountable to the first support above the lower end thereof and the other one of the end portions being a free end portion; and at least two connecting members, each one of the connecting members having a first end and an opposed second end, each one of the first ends being pivotally mountable to a respective one of the side portions of the at least one shelf between the end portions, and each one of the second ends being pivotally mountable to the second support above the lower end thereof;

the foldable shelving unit being operable between a deployed position wherein the at least one shelf and the at least two connecting members are pivoted to configure the first and second supports in a distal configuration with the at least one shelf extending therebetween, above the lower ends of the first and second supports, with each of the at least two connecting members extending inwardly of the side portions and under the supporting surface and the free end portion of the at least one shelf being contiguous to the second support, and a compacted position wherein the at least one shelf and the at least two connecting members are pivoted to configure the first and second supports in a proximal configuration.

2. The foldable shelving unit as claimed in claim 1, wherein the at least one shelf is at least two spaced-apart shelves spaced apart by at least a shelf length.

3. The foldable shelving unit as claimed in claim 1, wherein the at least two connecting members comprise arms and the first and second supports comprise panels.

4. The foldable shelving unit as claimed in claim 1, wherein the first and second supports are vertically oriented and substantially parallel to one another in the deployed position and the compacted position.

5. The foldable shelving unit as claimed in claim 1, wherein the at least one shelf is inclined relative to the first and second supports in the compacted position, and the at least one shelf is substantially perpendicular to the first and second supports in the deployed position.

6. The foldable shelving unit as claimed in claim 1, wherein the first ends of the connecting members are pivotally mounted to the at least one shelf, midway between the opposed end portions.

7. The foldable shelving unit as claimed in claim 1, wherein a pivot axis is defined upon pivotally mounting each of: the one of the end portions of the at least one shelf to the first support, each first end to one of the side portions of the at least one shelf, and each second end to the second support, each one of the pivot axes being substantially parallel to one another.

8. The foldable shelving unit as claimed in claim 1, wherein the at least one shelf extends upwardly from the one of the end portions pivotally mountable to the first support in the compacted position.

9. The foldable shelving unit as claimed in claim 1, wherein each second end and the one of the end portions of the at least one shelf comprise a limiting heel, the limiting heels abutting against at least one of the first and second supports in the deployed position.

10. The foldable shelving unit as claimed in claim 1, wherein the supporting surface of the at least one shelf comprises a handle adjacent to the other one of the end portions and the foldable shelving unit further comprises a tray for removably attaching to the first and second supports.

11. A vertical foldable shelving unit comprising :

at least two supports;

at least two spaced-apart shelves, each one of the shelves having a first end portion pivotally mountable to a first one of the supports, a free second end portion, spaced-apart and extending substantially parallel to the first end portion, opposed side portions, and a supporting surface extending between the first and second end portions; and at least two connecting members, each one of the connecting members having a first end pivotally mountable to a respective one of the side portions of the at least two shelves and a second end pivotally mountable to a second one of the supports, the at least two shelves and the at least two connecting members being pivotable between a compacted position wherein the at least two upright supports are in a proximal configuration and a deployed position, wherein the at least two shelves extend substantially horizontally between the at least two upright supports and are spaced-apart vertically along the at least two supports by at least a shelf length with the at least two connecting members extending inwardly of the side portions and under the supporting surface and the free second end portion of the at least two shelves being contiguous to the second one of the supports.

12. The vertical foldable shelving unit as claimed in claim 11, wherein the at least two connecting members are arms with the first ends being pivotally mounted to a respective one of the side portions of the at least two shelves, midway between the first and second end portions and the at least two supports comprise upright panels.

13. The vertical foldable shelving unit as claimed in claim 11, wherein the at least two spaced-apart shelves are inclined relative to the at least two supports in the compacted position.

14. A method for deploying and compacting a foldable shelving unit comprising first and second supports, at least one shelf having a first end portion pivotally mounted to the first support, a second free end portion, opposed side portions, and a supporting surface extending between the first and second end portions and the side portions, and at least two connecting members pivotally mounted to a respective one of the side portions of the at least one shelf and the second support, the method comprising:

pivoting the at least one shelf and the at least two connecting members in a first direction until the first and second supports are in a distal configuration with the at least one shelf extending therebetween with the free second end portion of the at least one shelf being contiguous to the second support with the at least two connecting members extending inwardly of the at least one shelf and supporting the at least one shelf, thereby deploying the foldable shelving unit; and pivoting the at least one shelf and the at least two connecting members in a second direction opposite the first direction until the first and second supports are in a proximal configuration, thereby compacting the foldable shelving unit.

15. The method as claimed in claim 14, wherein the first direction is downward and the second direction is upward.

16. The method as claimed in claim 14, wherein pivoting in the second direction comprises pivoting the at least one shelf and the at least two connecting members until the at least one shelf is inclined relative to the first and second supports at an angle not exceeding about 10°.

17. The method as claimed in claim 14, further comprising stopping the pivoting in the first direction upon the at least one shelf or the at least two connecting members abutting against the first or second supports.

18. A foldable shelving unit, comprising:

a first support and a second support; and at least one shelf assembly comprising a shelf with two opposed end portions, two opposed side portions and a supporting surface extending between the two opposed end portions, and at least two connecting members, the shelf being pivotally engageable to one of the first support and the second support and the at least two connecting members being pivotally engageable to the other one of the first support and the second support at a first pivoting point thereof and pivotally engageable to the side portions of the shelf at a second pivoting point thereof, spaced-apart from the first pivoting point and located between the opposed end portions, and a first one of the end portions being pivotally engaged to the one of the first support and the second support and a second one of the end portions being a free end;

the foldable shelving unit being operable between a deployed position wherein the at least one shelf assembly is pivoted to configure the first and second supports in a distal configuration with the shelf extending therebetween with the second one of the end portions being contiguous to the other one of the first support and the second support and the at least two connecting members extending inwardly of the side portions and supporting the shelf, and a compacted position wherein the at least one shelf assembly is pivoted to configure the first and second supports in a proximal configuration.

19. The foldable shelving unit as claimed in claim 18, wherein each one of the first support and the second support comprises an upright panel, and the at least two connecting members comprise arms.

20. The foldable shelving unit as claimed in claim 18, wherein the at least one shelf assembly comprises at least two spaced-apart shelf assemblies with the shelf of a first one of the at least two shelf assemblies being pivotally engageable to the first support and the shelf of a second one of the at least two shelf assemblies being pivotally engageable to the second support.

21. The foldable shelving unit as claimed in claim 18, wherein the first support and the second support extend substantially parallel to one another in the deployed position and the compacted position, and the shelf of the at least one shelf assembly extends substantially perpendicular to the first support and the second support in the deployed position and defines an oblique angle with the first support and the second support in the compacted position.

22. The foldable shelving unit as claimed in claim 18, wherein the second pivoting point is located midway between the opposed end portions of the shelf.

23. The foldable shelving unit as claimed in claim 18, wherein the supporting surface of the shelf is rigid and uncompactable.

* * * * *